US005325641A

United States Patent [19]

Felton

[11] Patent Number: 5,325,641

[45] Date of Patent: Jul. 5, 1994

[54] SYSTEM FOR MOUNTING A WALL PANEL

[75] Inventor: J. Reed Felton, Milwaukee, Wis.

[73] Assignee: T. J. Hale Company, Menonmonee Falls, Wis.

[21] Appl. No.: 5,814

[22] Filed: Jan. 19, 1993

Related U.S. Application Data

[63] Continuation-in-part of Ser. No. 830,059, Feb. 3, 1992, Pat. No. 5,189,850.

[51] Int. Cl.[5] ..... A47G 29/02

[52] U.S. Cl. ..... 52/36.4; 52/36.5; 52/474; 52/489.1

[58] Field of Search ..... 52/36.1, 36.4, 36.5, 52/36.6, 489, 281, 282.1, 282.4, 282.5

[56] References Cited

U.S. PATENT DOCUMENTS

| | | | |
|---|---|---|---|
| 2,174,145 | 9/1939 | Tummins | 52/489 |
| 3,815,309 | 6/1974 | Olsen | 52/489 |
| 3,881,293 | 5/1975 | Conville | 52/489 X |
| 4,201,025 | 5/1980 | Williamson | 52/489 |
| 4,596,094 | 6/1986 | Teller et al. | 52/489 X |
| 4,649,689 | 3/1987 | Everman et al. | 52/489 X |

FOREIGN PATENT DOCUMENTS

| | | | |
|---|---|---|---|
| 292082 | 7/1967 | Australia | 52/506.1 |
| 604487 | 7/1948 | United Kingdom | 52/486 |

*Primary Examiner*—Carl D. Friedman
*Assistant Examiner*—Kevin D. Wilkens
*Attorney, Agent, or Firm*—Jansson & Shupe, Ltd.

[57] ABSTRACT

The improved system is used for mounting a panel such as a sheet of dry wall or a plywood panel in a wall-like display structure of the type supporting wall panels having exposed exterior surfaces. The system includes a pair of studs such as sheet metal studs. Each stud has a flange surface (the narrow-edge surface of the stud) which is substantially coplanar with the flange surface of the other stud. A pair of upright members is interposed between the studs and each upright member includes a lip extending generally parallel to a stud flange surface. Several spring clips are attached to each lip and each clip includes an opening receiving a panel edge. Panels are thereby retained by the clips on the upright members.

11 Claims, 9 Drawing Sheets

11
13
29
43
41
15
53
39
35
49
33
31
37
45
10
67

SYSTEM FOR MOUNTING A WALL PANEL

RELATED APPLICATION

This application is a continuation-in-part of application Ser. No. 07/830,059 filed Feb. 3, 1992, titled SYSTEM FOR MOUNTING A WALL STANDARD, now U.S. Pat. No. 5,189,850.

FIELD OF THE INVENTION

This invention is related generally to interior building walls and, more particularly, to such walls constructed to display products thereon.

BACKGROUND OF THE INVENTION

Department and other types of retail stores frequently display products on perimeter or interior walls specially configured for the purpose. Such products may be hung from hooks or brackets or displayed upon shelves which, themselves, are supported by brackets projecting from the wall. Often, such speciallyconfigured walls are provided and installed by contractors or by contracting manufacturers on a bid basis.

Special walls constructed for the particular purpose of product display are said (in the vernacular of the industry) to include "wall standards," "key stripping" or "in-line standards." As used in the industry (and as used herein) the term "standard" is a noun referring to a vertically-oriented, relatively long, narrow strip, usually metal, which has spaced elongate slots along its length. Ends of support hooks or brackets are inserted into such slots to hold products or shelves. U.S. Pat. Nos. 3,848,364 (Costruba); 3,193,885 (Gartner et al.); 3,305,981 (Biggs et al.); 4,588,156 (Doke et al.); 4,535,525 (Varon et al.); 4,688,750 (Teague et al.); 2,040,385 (Kellogg); 4,918,879 (Bodurow et al.); 3,859,765 (Nelsson) all show types of wall systems used to mount wall standards.

Sometimes the wall is constructed so that the standard is concealed except to close inspection; in other wall arrangements, the standard is surface mounted. The former type is most often used commercially; the latter type is often used in private residences to make book shelves and the like. With surface mounted standards, the slotted standard is merely an "add-on" to an existing conventional wall. Of course, a benefit of wall standards is that hooks and brackets can be placed at any of a number of locations along the standard—and can just as easily be re-located as displays of products are modified to meet changing marketing needs.

Design, manufacture and installation of existing wall standard mounting systems, especially those used commercially in department stores and the like, are impeded in certain ways. One impediment is that some known systems require an existing wall for system mounting. To put it another way, such wall display systems must be installed according to the dictates of the existing building rather than in locations most effective from a display standpoint.

Another obstacle is that, characteristically, known wall standard systems are very labor intensive and require a good deal of on-site "cut and fit" by skilled, well-compensated persons. To state it differently, such systems do not lend themselves well to partial, more rapid wall fabrication at a remote manufacturing site where proper tools, jigs and the like are available.

Still another disadvantage of some known wall standard systems is that even though the fabricated wall system is substantially entirely made at a remote factory site, there is still a good deal of labor that must be expended on site to finish the task. Earlier workers in this field have not appreciated how a wall system can be configured to simply "clip-mount" wall panels without resorting to screws or other similar fasteners for that purpose.

The inventive system, summarized and described in detail below, resolves many of these disadvantages in a unique way.

OBJECTS OF THE INVENTION

It is an object of this invention to provide an improved wall system overcoming some of the problems and shortcomings of devices of the prior art.

Another object of this invention is to provide an improved wall system which clip-mounts wall panels.

Yet another object of this invention is to provide an improved wall system which mounts panels without resorting to threaded fasteners.

Another object of this invention is to provide an improved wall system useful to erect perimeter or free-standing interior display walls.

Still another object of this invention is to provide an improved wall system readily accommodating wall panels of differing thicknesses.

Another object of this invention is to provide an improved wall system securely retaining a panel in position. These and other important objects will be apparent from the following detailed description taken in conjunction with the drawing.

SUMMARY OF THE INVENTION

The improved system is used for mounting a panel such as a sheet of dry wall or a plywood panel in a wall-like display structure of the type supporting wall panels having exposed exterior surfaces. The system includes a pair of studs such as sheet metal studs. Each stud has a flange surface (the narrow-edge surface of the stud) which is substantially coplanar with the flange surface of the other stud. A pair of upright members is interposed between the studs and each upright member includes a lip extending generally parallel to a stud flange surface. At least one spring clip is attached to each lip and includes an opening receiving a panel edge. The panel is thereby retained in a mounted position relative to the studs.

In a more specific aspect, the clip includes a first side portion and a retaining portion defining a relatively thin slot between them. A lip extends into the slot "tongue-and-groove" fashion for retaining the clip on the upright member. The retaining portion is thereby interposed between the lip and the flange surface of a stud and the clip is retained on the lip and, thus, on the upright member.

The opening which receives the panel edge is generally U-shaped and is defined by an end portion, by the first side portion and by a second side portion, both side portions extending from the end portion. In a highly preferred arrangement, the second side portion angles toward the first side portion so that the clip grasps and compressively retains the panel edge by friction forces as well as by the tabs described below.

At least one side portion and, preferably, both side portions each include one or more barb-like tabs bent inward toward the opening. That is, the tabs of one side portion are bent toward those of the other side portion.

The tabs extend in the direction of panel edge insertion and therefore, do not interfere with such insertion as the system is being erected and the panels mounted thereon. However, the sharp edges of each tab "bite into" and therefore prevent easy withdrawal of the panel in a lateral or horizontal direction and also help prevent the panel from sliding downward under the force of gravity.

The system is particularly useful in display structures having what is known as a "standard," i.e., a flat, bar-like apertured strip secured between the upright members for supporting a bracket. Each spring clip attached to the lip of a particular upright member and its nearby "companion" clip attached to the lip of the other upright member define a gap between the clips. A bracket is received through the gap for bracket attachment to the standard.

DETAILED DESCRIPTION OF THE PREFERRED EMBODIMENTS

Figure 1:
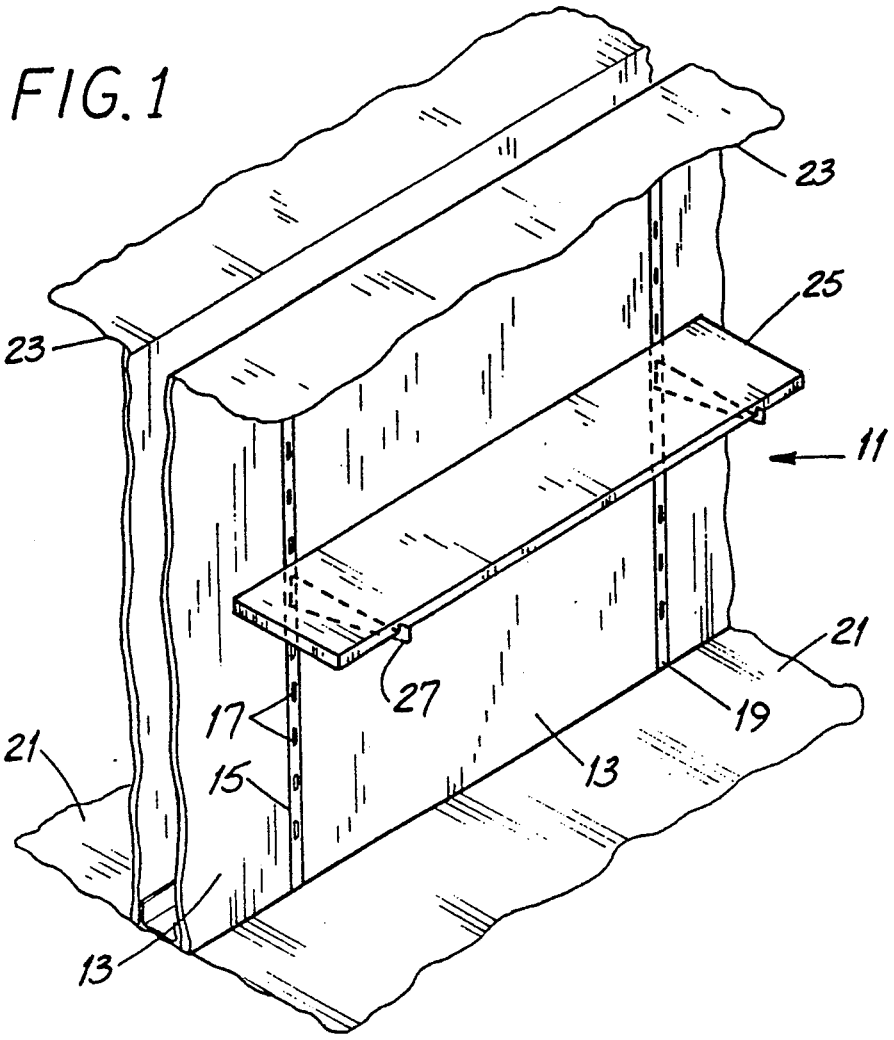
FIG. 1 is a representative perspective view, with parts broken away and other parts in phantom outline, of a "wall standard" type display wall.

Before describing the details of the inventive system 10, it will be helpful to refer to FIG. 1 showing how such system 10 is used. The illustrated wall 11 includes outer panels 13, often decorative, seen by individuals viewing displayed products. The wall 11 includes one or more vertical "standards" 15 with slots 17. In practice, the standard 15 is "inset" somewhat behind the panels 13 and is visible only upon closer inspection. However, the gap 19 between panels 13 is clearly visible and is considered by many to detract from the aesthetics of the display. As described below, the inventive system 10 offers (among other advantages) a way to minimize the width of such gap 19.

The display wall 11 may extend between floor 21 and ceiling 23 as shown or be foreshortened, e.g., to countertop height. The wall 11 may be single-sided as represented by the forward wall 13 if used alone. Or it may be double sided as shown. Products are displayed on one or more shelves 25 supported by brackets 27 hooked into slots 17. Typically, there are a number of slots 17 along the standard 15 so that the vertical position of the shelf 25 can be selected for most advantageous product display. And only a single bracket 27 or hook can be used to display, for example, purses hung therefrom.

Figure 2:
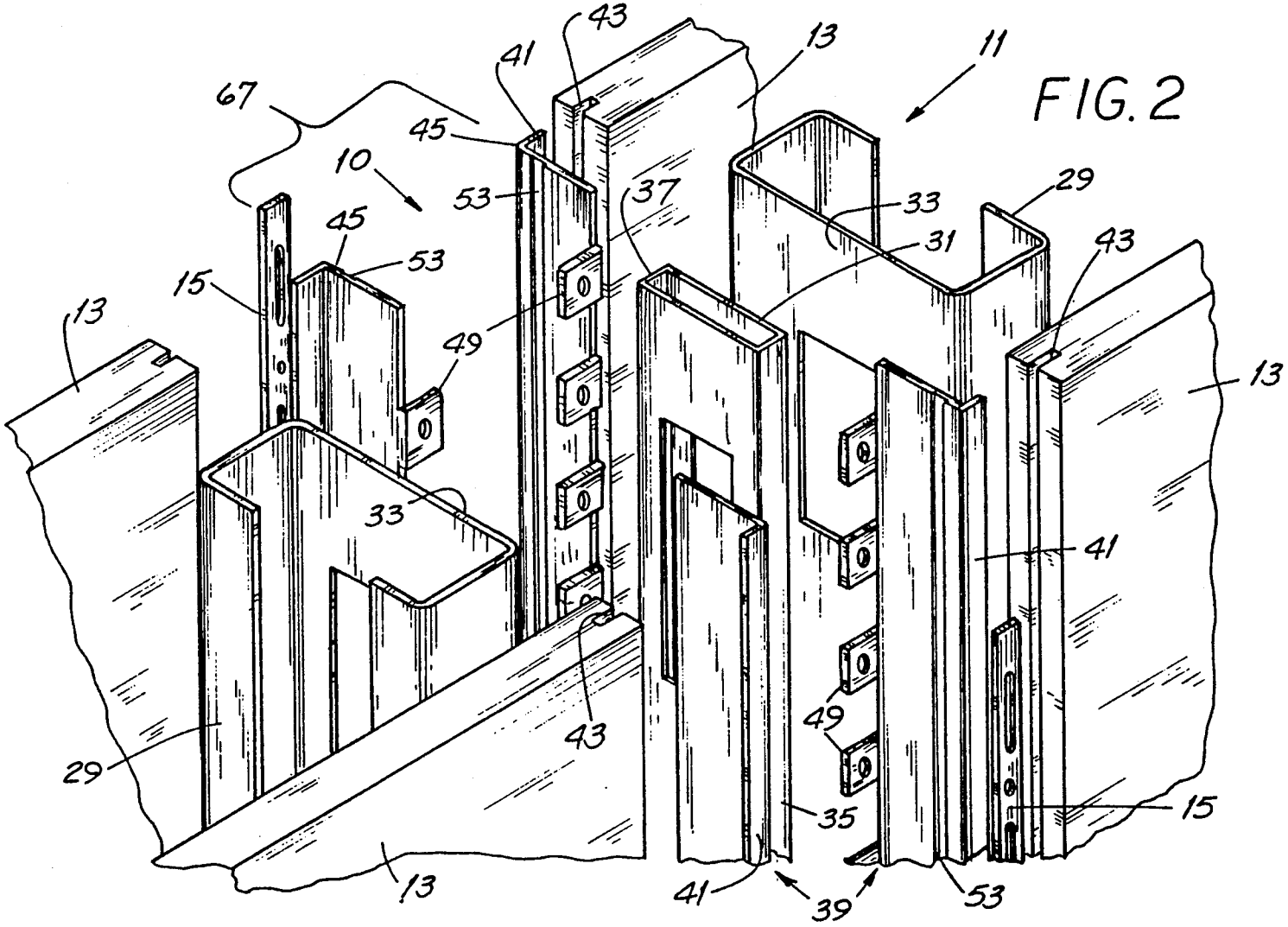
FIG. 2 is an "exploded" perspective view, with parts broken away, showing aspects of the inventive system.
Figure 3:
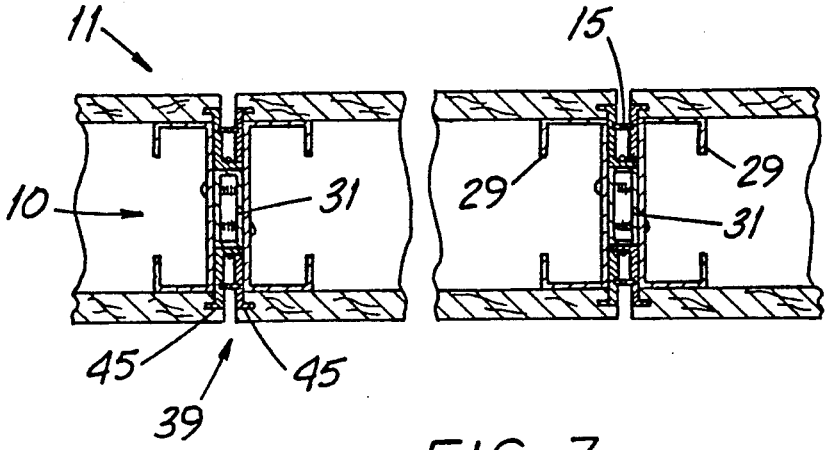
FIG. 3 is a top plan view, partly in section and with parts broken away, of a double-sided display wall incorporating the system of FIG. 2.

Referring next to FIGS. 2 and 3, the improved system 10 will now be described. Such system 10 is shown in connection with a double sided wall 11 but after understanding the specification, one will appreciate how the system 10 is used in a single-sided wall 11, freestanding or floor-to-ceiling.

The system 10 is used for mounting a wall standard 15 in a wall-like display structure of the type having plural support studs 29, e.g., conventional sheet metal studs (as shown) or 2×4's. The improved system 10 includes a box-like "filler" or spacer 31 of rectangular cross-section. The spacer 31 is mounted between the wider faces 33 of adjacent studs 29 so as to separate them slightly. Although the view of FIG. 2 shows various components in spaced-apart locations, in practice the spacer 31 and the studs 29 are in abutting relationship (as are other components) as shown in FIG. 3. The spacer 31 may include a cutout opening for installing electrical wiring or the like in the wall 11.

The spacer 31 has a first attachment edge 35 and, preferably, an oppositely-facing second attachment edge 37. A first retention assembly 39 attaches to the edge 35 and engages and supports one or more wall panels 13 in ways described below. In the arrangement of FIGS. 2 and 3, panel support is by a lip 41 fitted into a groove 43 in the edge of the panel 13. The retention assembly 39 includes a pair of commonly-shaped upright members 45; that is, such upright members 45 are essentially identical to one another.

Figure 4:
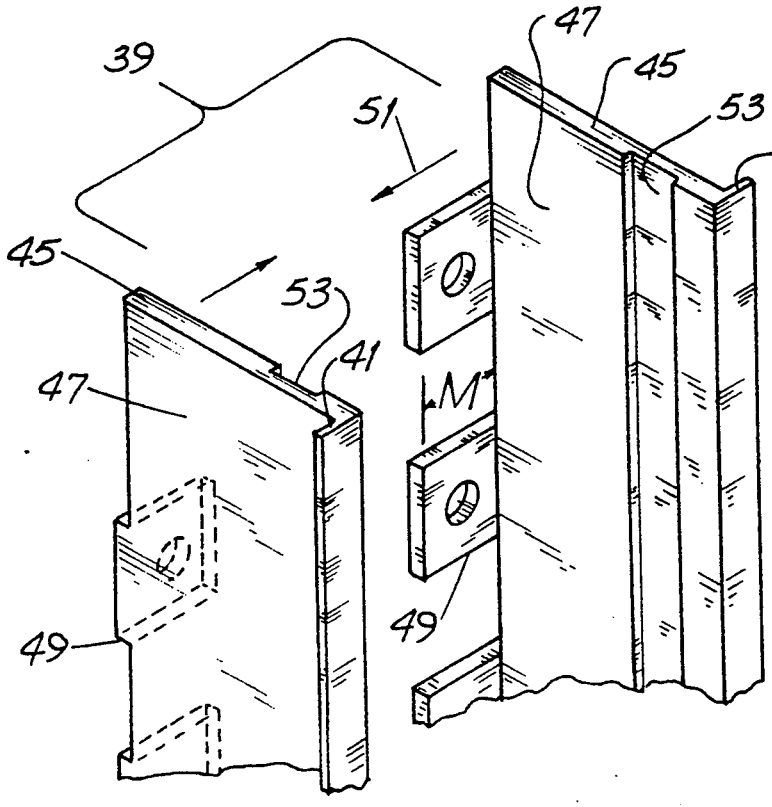
FIG. 4 is a perspective view, with parts broken away and other parts in phantom outline, of a retention assembly used in the system of FIG. 2.

Referring additionally to FIG. 4, each upright member 45 includes a web 47, a plurality of attachment tabs 49 spaced along one edge of the web 47 and a panel retaining lip 41 along its other edge. When mounted in inverted relationship one to the other, each member 45 has at least one tab 49 interposed between a pair of tabs 49 of the other member 45. In fact, virtually all tabs 49 of each member 45 are interposed between tabs 49 of the other in something of an "interdigitated" relationship when the upright members 45 are "fitted" toward one another as suggested by the arrows 51 in FIG. 4. In practice, tabs 49 of a given upright member 45 are spaced on about six inch centers but this dimension is not critical.

Each tab 49 has a width "W" (measured parallel to a floor) closely similar to that of the strip-like standard 15 "captured" between the upright members 45 in a finished wall 11. Selected tabs 49 are attached by sheet metal screws to the edge 35 of the spacer 31 for panel support. The shape of the upright member 45 is such that it lends itself well to fabrication by extrusion and stamping and bending to form the tabs 49.

The webs 47 of those two upright members 45 making up a retention assembly 39 are spaced by about a tab width "W" from that of its companion upright member 45. The tab-to-lip spacing is substantially equal to the width of the web 47. And each such upright member 45 also has a groove 53 for receiving an edge of the standard 15.

Since the standards 15 may bear significant weight, it is preferred that they be solidly retained in the finished wall 11. Such retention is aided by serrating that side of the standard 15 engaging the web 47.

Figure 5:
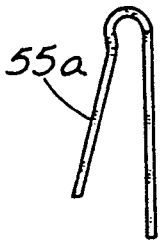
FIG. 5 is a side elevation view of a spring retainer device used with a retention assembly.

Upon initial placement of the standard 15, it is adjustably retained between the grooves 53 by a spring device 55*a* such as that shown in FIG. 5. Such temporary retention makes it very easy to assure that the display shelves 25, etc. (mounted on the wall 11 at the conclusion of construction) are level. The wall standards 15 can be lightly "tapped" up or down until a reference line drawn through corresponding locations, e.g., the tops of the first slots 17, on the standards 15 is level.

Figure 7:
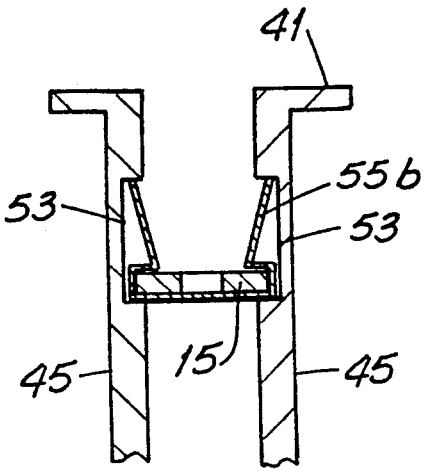
FIG. 7 is a top plan view like that of FIG. 6 and showing another type of spring retainer device.
Figure 8:
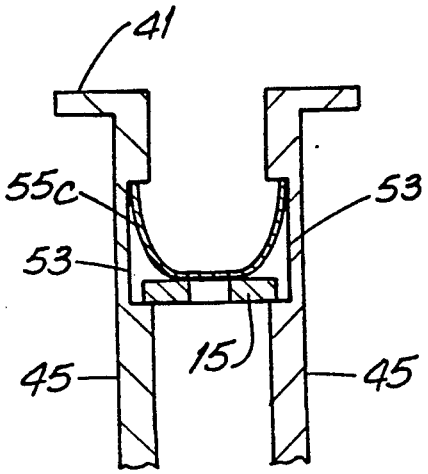
FIG. 8 is a top plan view like that of FIG. 6 showing yet another type of spring retainer device.
Figure 6:
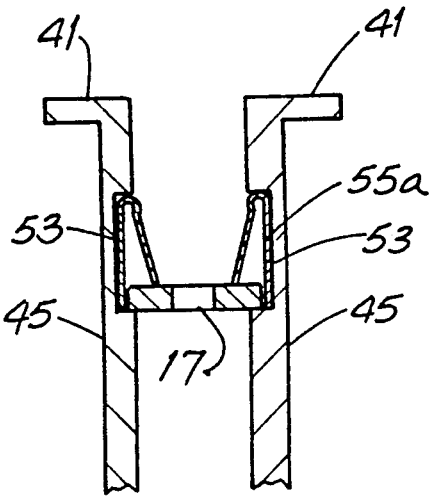
FIG. 6 is a top plan view, in section and with parts broken away, of aspects of the system of FIG. 2 and using a device like that shown in FIG. 5.

As shown in FIG. 6, the spring device 55*a* may be fitted into the groove 53 of at least one upright member 45 for standard retention. Or as shown in FIG. 7, another type 55*b* of spring device is conformably fitted to (or partially wrapped around) the standard 15. Such device 55*b* engages the grooves 53 of the upright members 45 for temporary standard retention when the standard 15 is inserted between the members 45. Another type of standard-retaining spring device 55*c*, U-shaped, is shown in FIG. 8. After locating the standard(s) 15, a long sheet metal screw is inserted through a few of the several screw holes 57 in the standard 15 and attached to an edge 35 or 37 of the spacer 31.

Figure 10:
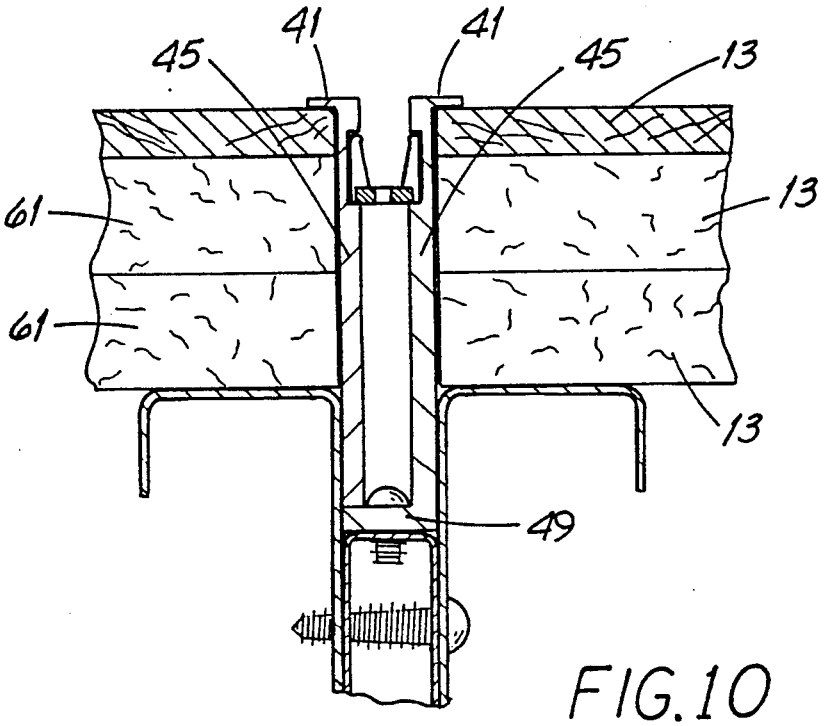
FIG. 10 is a top plan view like that of FIG. 3 and showing another variation of the system of FIG. 2.
Figure 9:
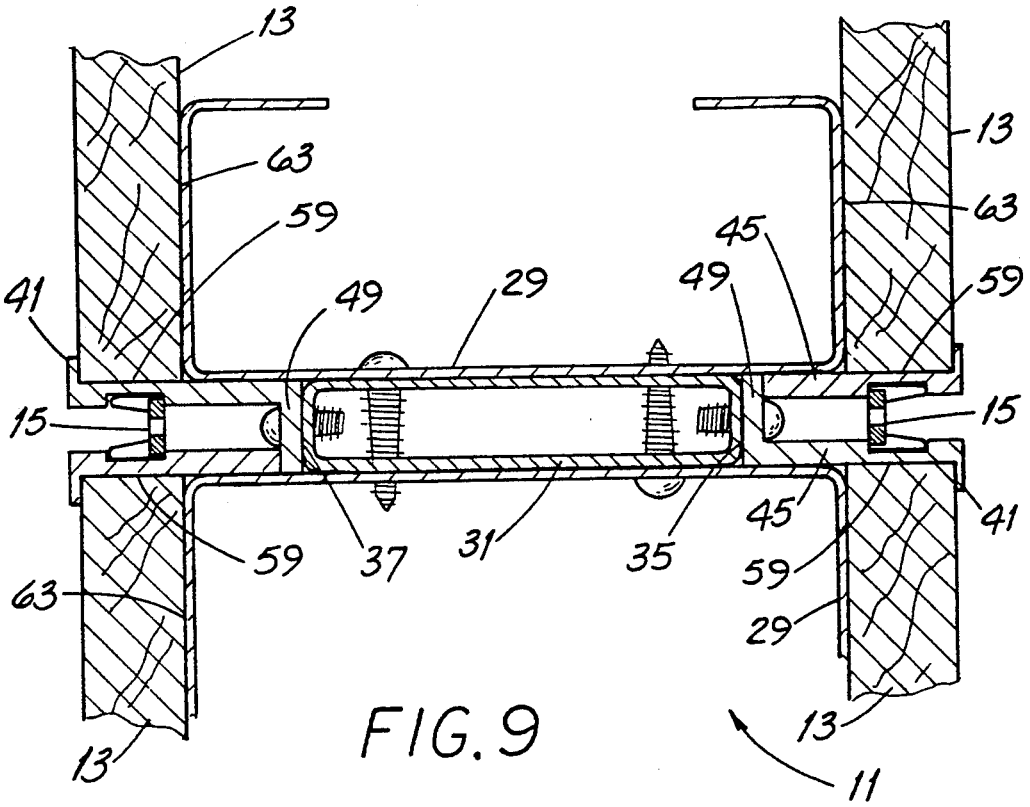
FIG. 9 is a top plan view like that of FIG. 3 and showing a variation of the system of FIG. 2.

Referring next to FIGS. 9 and 10, the new system 10 offers enormous flexibility in constructing perimeter and interior wall standard systems where panels 13 of differing thicknesses may be required to be used. For example, the system 10 may include two or more pairs of upright members 45 , each member 45 of each pair having attachment tabs 49 and a retaining lip 41. A pair of upright members 45, like the members shown in FIG. 9, includes tab-to-lip spacing differing from that of another pair of upright members 45 such as those shown in FIG. 10. The system 10 thereby accommodates panels 13 of differing thicknesses.

In the arrangement of FIG. 9, each side of the wall 11 is "faced" by a single layer of panels 13, the edges 59 of which are slightly spaced apart from one another. The illustrated panels 13 are of the same thickness—but need not be. For example, one side of the wall of FIG. 9 may (as shown in FIG. 10) include two layers 61 of gypsum drywall panel 13 and an outer finish panel 13, the aggregate thickness of such composite panel 13 is being significantly greater than that of the panels 13 in FIG. 9.

Figure 11A:
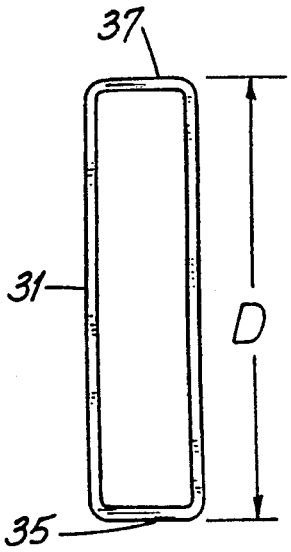
FIGS. 11A, 11B and 11C are top plan view of various sizes of spacers used in the system of FIG. 2.
Figure 11B:
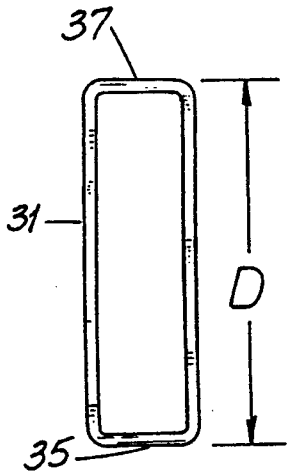
Figure 11C:
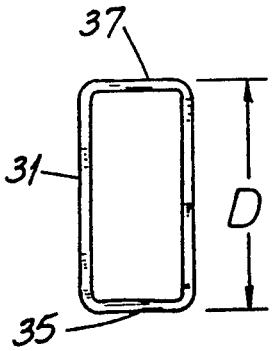

But the new system 10 offers yet more flexibility; the same result may be achieved in other ways. Referring to FIGS. 11A–11C, inclusive, the system 10 may include two or more spacers 31, each having a face dimension "D" differing from that of at least one other spacer 31. This feature also accommodates panels 13 of differing thicknesses. With or without upright members 45 having differing tab-to-lip spacing, a spacer 31 can be "offset," i.e. positioned to have one attachment edge 35 closer to the corresponding stud flange surfaces 63 than the other edge 37 is to its corresponding flange surfaces 63. When so arranged, panels 13 of differing thicknesses can be used even if the tab-to-lip spacing of upright members 45 is the same. Of course, spacers 31 of differing face dimensions "D" and upright members 45 having differing tab-to-lip spacing can be used separately or combined in a single installation. To recap, the installer can accommodate panels 13 of different thicknesses by using (a) spacers 31 of differing face dimensions "D", (b) upright members 45 with differing tab-to-lip spacing and/or (c) offset the position of the spacer 31 with respect to the stud flange surfaces 63.

Figure 12:
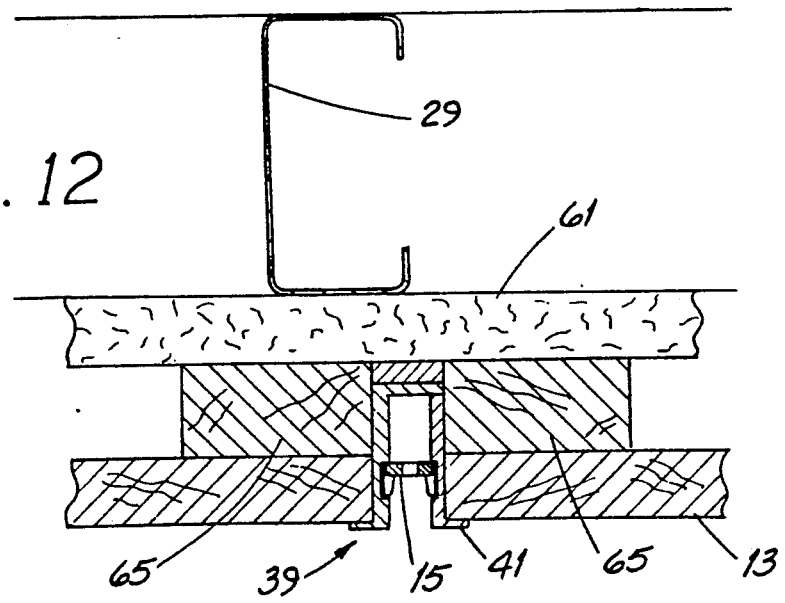
FIG. 12 is a top plan view, partly in section and with parts broken away, illustrating aspects of the system used to make a single-sided display wall.

The improved system 10 lends itself to construction of a perimeter display wall 11, i.e., one mounted to an existing wall.) and of double-sided interior walls 11, whether or not freestanding. FIG. 12 indicates how to construct the former. Wood furring strips 65 are spaced by about the width of a tab 49 and attached to the surface of an existing drywall 61. A retention assembly 39 has a tab-to-lip thickness selected in view of the thickness of the strips 65 and the panels 13 to be mounted. If necessary, thin shims can be placed between the tabs 49 and the drywall 61 to obtain proper spacing between the lip 41 and the strip 65.

A double-sided wall 11 is shown in FIG. 2. Therein, the spacer 31 includes a second attachment edge 37 and a second retention assembly 67 having a pair of upright members 45 attached to the second edge 37 for panel support. It is to be understood that in the arrangements shown in FIGS. 2, 3, 9 and 10, panel retention is by clamping the panel 13 between a lip 41 and that surface 63 immediately behind the panel.

Figure 13:
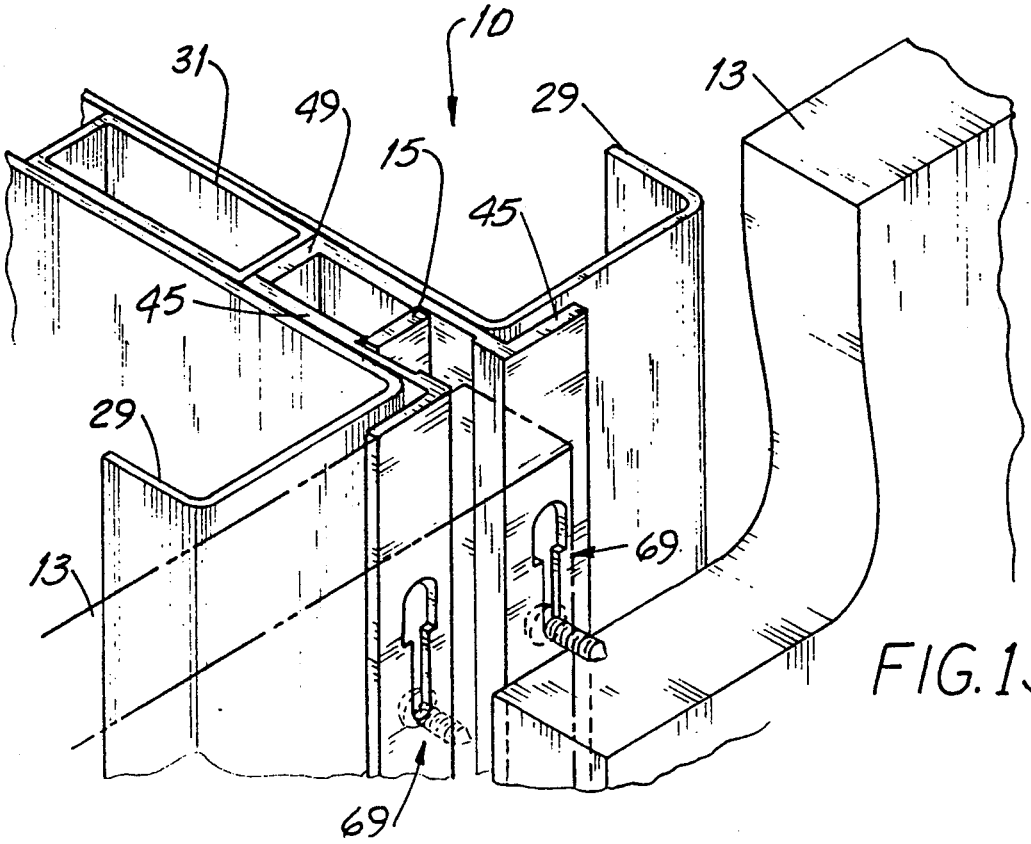
FIG. 13 is a perspective view, partly in phantom and with parts broken away, showing an arrangement having a pin-and-groove panel attachment device useful in conjunction with other aspects of the system.
Figure 14:
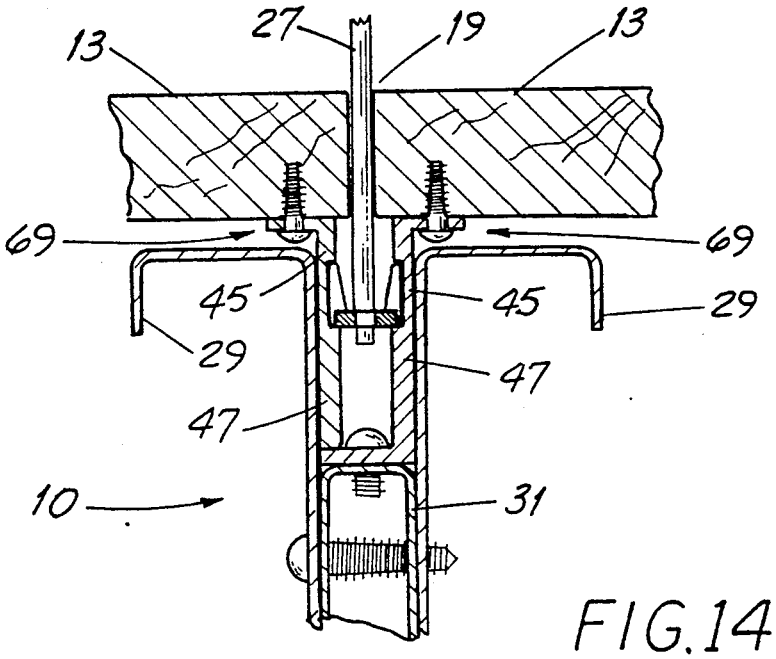
FIG. 14 is a top plan view, partly in section and with parts broken away, of the arrangement of FIG. 13.

Ease of initial panel mounting and of wall rearrangement or removal are important considerations in wall standard systems. Accordingly, FIGS. 13 and 14 show the system 10 to include panels 13 mounted to upright members 45 (rather than to studs 29) by pin-and-groove devices 69. The upright members 45 support substantial panel weight and the system 10 uses conventional studs 29. With such an arrangement, the gap 19 between panels 13 can be, and preferably is, substantially smaller than the spacing between webs 47. In fact, such gap 19 need be only provide slight clearance for insertion of a bracket 27 or hook. The new system 10 thereby makes the gap 19 as unobtrusive as possible and, consequently, the overall display wall 11 is more attractive.

Figure 15:
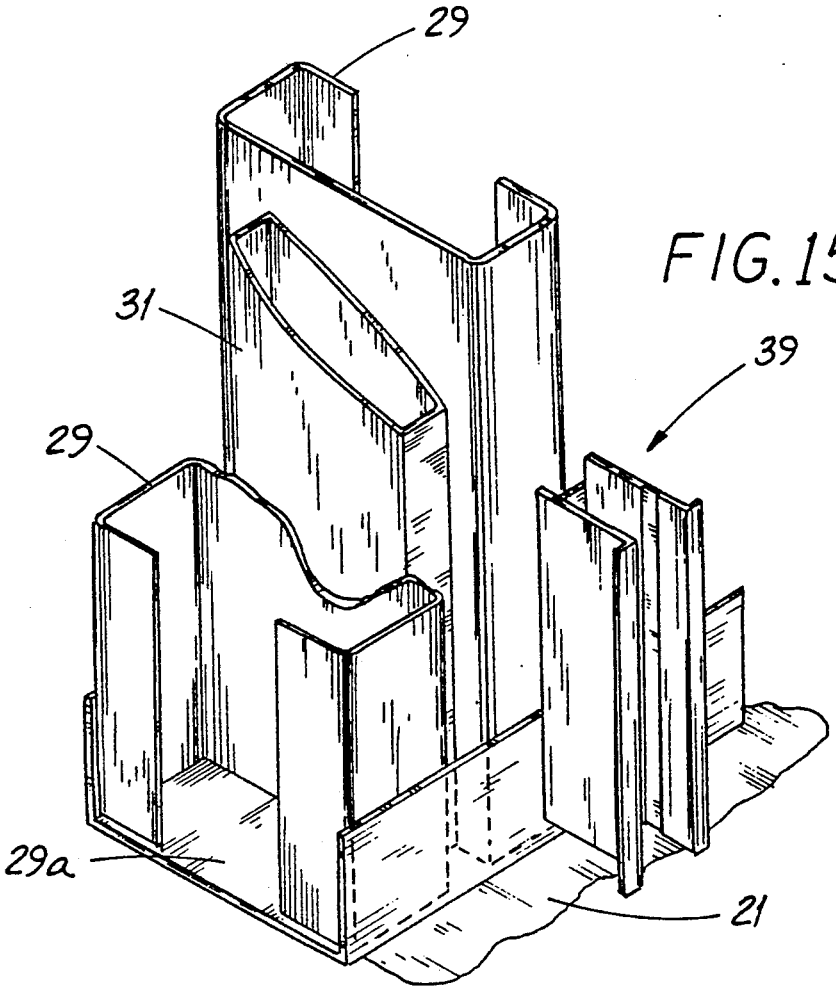
FIG. 15 is an elevation perspective view, partly in dashed outline and with parts broken away, illustrating aspects of the system useful to make a freestanding display wall.

FIG. 15 shows how to frame a freestanding wall 11. A "runner" or base stud 29*a* is attached to the floor 21 and vertical studs 29 are attached at either end of the stud 29*a* and at least one intermediate location along the length of such stud 29*a*. A spacer 31 is between a pair of vertical studs 29 and the retention assembly 39 and other hardware are mounted as described above.

Figure 16:
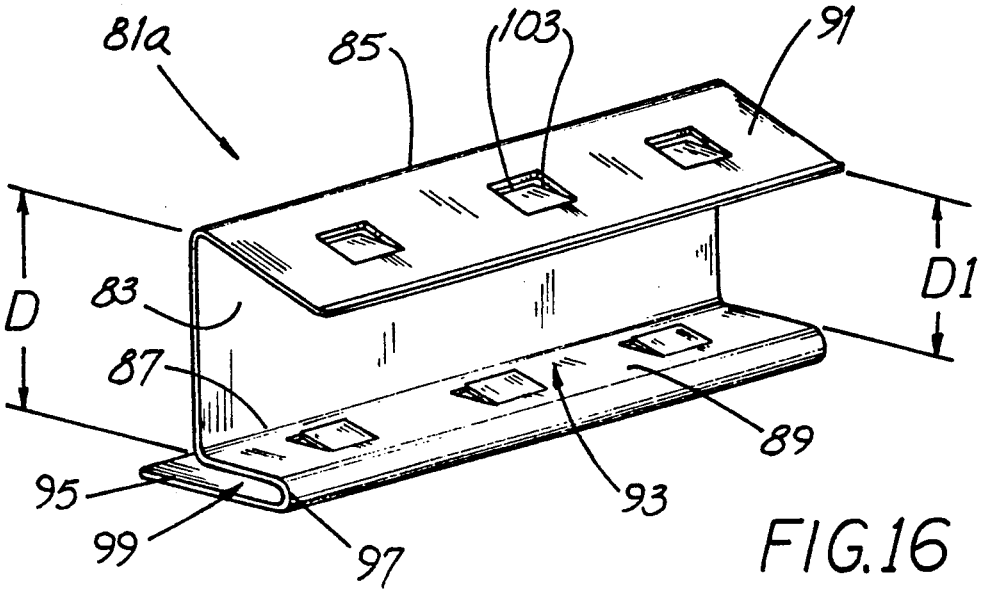
FIG. 16 is an isometric view of one embodiment of a spring clip for mounting a wall panel.

Referring now to FIG. 16, another aspect of the inventive system includes a clip 81*a*, preferably made of spring steel or the like, for mounting a wall panel 13. The clip 81*a* has a rectangular, generally flat end portion 83 with generally parallel first and second edges 85, 87. First and second side portions 89 and 91, respectively, are attached to the edges 87 and 85, respectively, extend from such edges 87, 85 and with the edges 87, 85 define an opening 93 for receiving the edge of a wall panel 13.

The dimension "D" between the edges 85, 87 is nominally equal to the thickness of a wall panel 13, e g., a sheet of plywood or of drywall or "sheet rock," as the latter is sometimes called. However, the side portions 89, 91 converge toward one another (and in the specific embodiment, the second portion 91 converges toward the first portion 89 at an angle of about 15°) so that the dimension "D1" across the mouth of the opening is less than dimension "D." When so formed and when the edge of the wall panel 13 is inserted in the opening 93, the clip 81*a* securely "clamps" or grasps such panel 13.

Figure 17:
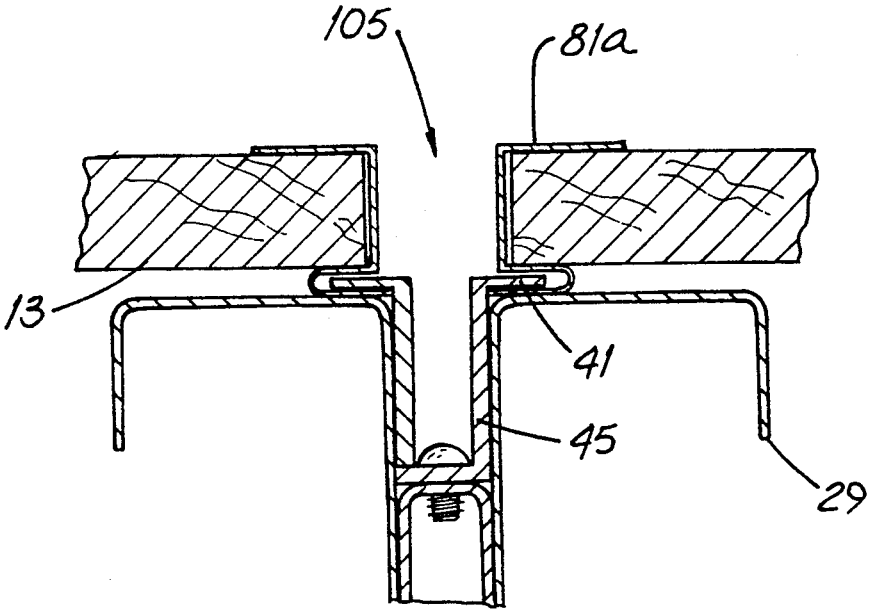
FIG. 17 is a top plan view, partly in section and with parts broken away, of another arrangement similar to that of FIG. 13 but using spring clips like that shown in FIG. 16 for mounting a wall panel.

Referring also to FIG. 17, the clip also includes a "doubled back" retaining portion 95 attached to the distal edge 97 of the first side portion 89. The retaining portion 95 and the side portion 89 converge slightly toward one another and such portions 89, 95 define a slot 99 therebetween for receiving a lip 41 of an upright member 45. Preferably the minimum space between the portions 89, 95 is selected to be slightly less than the thickness of a lip 41 so that the clip 81*a* is securely retained on such lip 41.

Each side portion 89, 91 includes a plurality of barb-like tabs 101 formed therein by shearing the portion 89, 91 and folding the tab 101 slightly inward toward the opening 93. The tab 101 extends toward the end portion 83 and the tab distal edge and side edges 103 are "raw" or relatively sharp. Such sharp edges 103 are preferred in that when the edge of the panel 13 is inserted into the opening 93 as shown in FIG. 17, the tab 101 bites into the panel 13 and may not easily be withdrawn. Similarly, the panel 13 is restrained from falling downward through the clip 81*a* (in a direction into the paper in the view of FIG. 17) under the urging of gravity.

The clip 81*a* is attached to a lip 41 by pushing the clip 81*a* onto the lip 41 so that such lip 41 extends into the slot 99 "tongue-and-groove" fashion. The retaining portion 95 is thereby interposed between the lip 41 and the flange surface 63 of a stud 29 and the clip 81*a* is retained on the lip 41 and, thus, on the upright member 45.

Figure 18:
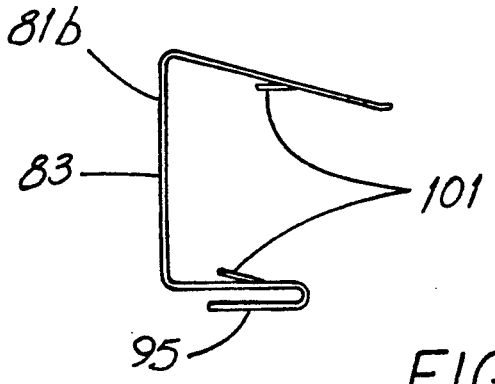
FIG. 18 is an edge elevation view of another embodiment of a spring clip for mounting a wall panel.

The clip 81*b* shown in FIG. 18 differs only slightly from the clip 81*a* of FIG. 16. Clip 81*b* has a retaining portion 95, the length of which is foreshortened so that it extends toward but not to the end portion 83.

In use, several spring clips 81 are spaced along each lip 41 and attached to a lip 41 as described above. The clips 81 attached to each of the upright members 45 of a particular retention assembly 39, 67 need not be the same in number as or be aligned side by side with the clips 81 attached to the other upright member 45 of such assembly. However, the installation will have a neater appearance when the clips 81 are equal in number and so arranged.

Irrespective of whether clips 81 on a lip 41 are aligned side by side with those of the other upright member 45 of a retention assembly 39, 67, such clips 81 (and, more specifically, the end portions 83 of such clips) define a gap 105 therebetween. A bracket 27 is received through the gap 105 for bracket attachment to the standard 15.

Figure 19:
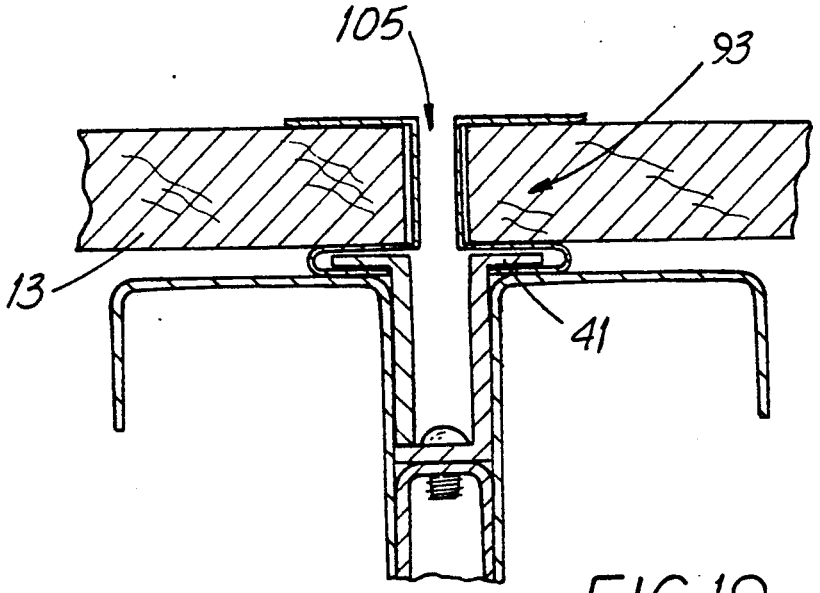
FIG. 19 is a top plan view, partly in section and with parts broken away, of another arrangement similar to that of FIG. 17 but using spring clips like that shown in FIG. 18 for mounting a wall panel.

As shown in FIG. 17, a relatively wide gap 105 results when the clip 81*a* is used. On the other hand, many consider that a relatively thin gap 105 is aesthetically more acceptable and in those instances, clip 81*b* is used as shown in FIG. 19.

While the principles of this invention have been described in connection with specific embodiments, it should be understood clearly that these descriptions are made only by way of example and are not intended to limit the scope of the invention.

I claim:

1. In a wall-like display structure of the type supporting wall panels each having (a) an edge, (b) an exterior surface and (c) an interior surface parallel to the exterior surface, an improved system for mounting a wall panel and including:

a pair of studs, each stud having a flange surface substantially coplanar with the flange surface of the other stud;

a pair of upright members interposed between the studs, each upright member being spaced from the other upright member and including a lip spaced from the lip of the other upright member and extending generally parallel to a stud flange surface; and, a spring clip attached to each lip, each clip including an opening receiving the edge of a separate panel, each clip contacting the inner and outer surfaces of the panel received therein, whereby the panels are retained in a mounted coplanar position relative to the studs.

2. The system of claim 1 wherein the clip includes a slot and a lip extends into the slot for retaining the clip on the upright member.

3. The system of claim 2 wherein the opening is generally U-shaped and defined by an end portion and by first and second side portions extending from the end portion.

4. The system of claim 3 wherein both side portions include a barb-like tab bent toward the opening.

5. The system of claim 3 wherein the second side portion angles toward the first side portion.

6. The system of claim 1 further including:

a standard between the upright members for supporting a bracket; and wherein:

the spring clips define a gap therebetween for receiving the bracket therethrough for bracket attachment to the standard.

7. The system of claim 6 wherein the clip includes a first side portion and a retaining portion defining a slot therebetween and a lip extends into the slot for retaining the clip on the upright member.

8. The system of claim 7 wherein the retaining portion is interposed between the lip and the flange surface of a stud.

9. In a wall-like display structure of the type supporting wall panels having exterior surfaces, an improved system for mounting a wall panel and including:

a pair of studs, each stud having a flange surface substantially coplanar with the flange surface of the other stud;

a pair of upright members interposed between the studs, each upright member including a lip extending generally parallel to a stud flange surface;

a standard between the upright members for supporting a bracket;

at least one spring clip attached to each lip, each clip including an opening receiving a panel edge;

and wherein:

the spring clips define a gap therebetween for receiving the bracket therethrough for bracket attachment to the standard, whereby the panel is retained in a mounted position relative to the studs.

10. The system of claim 9 wherein the clip includes a first side portion and a retaining portion defining a slot therebetween and the lip extends into the slot for retaining the clip on the upright member.

11. The system of claim 10 wherein the retaining portion is interposed between the lip and the flange surface of the stud.

* * * * *